US007909487B1

(12) United States Patent
Venetucci et al.

(10) Patent No.: US 7,909,487 B1
(45) Date of Patent: Mar. 22, 2011

(54) LIGHTING SYSTEM AND METHOD OF MAKING SAME

(75) Inventors: Patricia Venetucci, Hawthorn Woods, IL (US); Lawrence J Labedz, Naperville, IL (US); William Carter, Dyer, IN (US)

(73) Assignee: Keyser-Group, Evergreen Park, IL (US)

( * ) Notice: Subject to any disclaimer, the term of this patent is extended or adjusted under 35 U.S.C. 154(b) by 0 days.

(21) Appl. No.: 12/717,773

(22) Filed: Mar. 4, 2010

(51) Int. Cl.
*F21V 17/00* (2006.01)

(52) U.S. Cl. ..... 362/364; 362/147; 362/148; 362/362; 362/365; 362/368

(58) Field of Classification Search ..... 362/147–148, 362/362, 364–365, 368
See application file for complete search history.

(56) References Cited

U.S. PATENT DOCUMENTS 5,673,997 A 10/1997 Akiyama
5,746,507 A 5/1998 Lee
6,030,102 A 2/2000 Gromotka
6,350,046 B1 2/2002 Lau
7,399,104 B2 7/2008 Rappaport
7,513,658 B2 4/2009 Shen
2009/0135608 A1 5/2009 Sell

*Primary Examiner* — Stephen F Husar
*Assistant Examiner* — Meghan K Dunwiddie
(74) *Attorney, Agent, or Firm* — Beem Patent Law Firm

(57) ABSTRACT

A retrofit can lighting system is disclosed. The retrofit can lighting system may be configured to be mounted in an opening in a ceiling above a plane of the ceiling, wherein an existing fixture ceiling ring is proximate the opening and also is above the plane of the ceiling. The system may include a lighting can, and a plurality of spring clips configured to couple between the lighting can and the ceiling ring. Each spring clip may include a can engaging portion configured to couple to the lighting can, a retainer clip engaging portion extending outwardly with respect to the can engaging portion, a fixture engaging portion configured to engage a portion of the ceiling ring, wherein the fixture engaging portion is angled upwardly with respect to the retainer clip engaging portion, and a hook portion configured to engage a portion of the ceiling ring, wherein the hook portion extends outwardly and downwardly with respect to the fixture engaging portion. The system further may include a plurality of retainer clips, wherein each retainer clip is configured to couple to retainer clip engaging portion, and further wherein each retainer clip is configured to secure coupling the lighting can and the ceiling ring.

19 Claims, 7 Drawing Sheets

LIGHTING SYSTEM AND METHOD OF MAKING SAME

BACKGROUND OF THE INVENTION

1. Field of the Invention

The present invention is directed to a lighting system.

2. Description of the Related Art

In industry, many companies have existing buildings with existing light fixtures and/or lighting systems within the ceilings. With the green initiative, many existing light fixtures are being replaced with replacement fixtures that are configured to receive light bulbs or lamps that are more cost efficient and last longer.

When replacing an existing light fixture with a replacement light fixture, many problems arise. For example, the existing light fixture may have a diameter that is greater than the diameter of the replacement light fixture. As such, if a user were to try and install a replacement light fixture into the existing opening in a ceiling panel for the existing light fixture, the opening would be too wide to hold the replacement light fixture in place. Even if a user could figure out a way to retain the replacement light fixture within the existing opening, there would be an unsightly opening between the replacement light fixture and the ceiling panel. Another problem with replacing existing light fixtures is the waste created from replacing existing light fixtures, as many installations that occur do not use any remaining portion of the existing light fixture when installing the replacement light fixture.

What is needed is an apparatus that overcomes the drawbacks described above.

BRIEF SUMMARY OF THE INVENTION

In one aspect, a retrofit can lighting system is disclosed. The retrofit can lighting system may be configured to be mounted in an opening in a ceiling above a plane of the ceiling, wherein an existing fixture ceiling ring is proximate the opening and also is above the plane of the ceiling. The system may include a lighting can, and a plurality of spring clips configured to couple between the lighting can and the ceiling ring. Each spring clip may include a can engaging portion configured to couple to the lighting can, a retainer clip engaging portion extending outwardly with respect to the can engaging portion, a fixture engaging portion configured to engage a portion of the ceiling ring, wherein the fixture engaging portion is angled upwardly with respect to the retainer clip engaging portion, and a hook portion configured to engage a portion of the ceiling ring, wherein the hook portion extends outwardly and downwardly with respect to the fixture engaging portion. The system further may include a plurality of retainer clips, wherein each retainer clip is configured to couple to retainer clip engaging portion, and further wherein each retainer clip is configured to secure coupling the lighting can and the ceiling ring.

In another aspect, a spring clip is disclosed. The spring clip may include a can engaging portion configured to couple to a lighting can, a retainer clip engaging portion extending outwardly with respect to the can engaging portion, wherein the retainer clip engaging portion is substantially normal to the can engaging portion, a fixture engaging portion configured to engage a portion of a ceiling ring, wherein the fixture engaging portion is angled upwardly with respect to the retainer clip engaging portion, a hook portion configured to engage a portion of the ceiling ring, wherein the hook portion extends outwardly and downwardly with respect to the fixture engaging portion, a spacing portion extends upwardly at an angle via a radius with respect to hook portion, and a leading portion, wherein the leading portion extends upwardly and inwardly via a radius with respect to the spacing portion.

In a further aspect, a one-inch retainer clip is disclosed. The one-inch retainer clip may include at least two engaging portions, a first engaging portion is configured to couple to a lighting can and a second engaging portion is configured to couple to a ring, a projection between the at least two engaging portions, and an opening defined within the projection, wherein the opening is configured to receive a bolt therein.

In another aspect, a method of assembling a retrofit can lighting system is disclosed. The method may include providing a lighting can and coupling a plurality of spring clips to an exterior surface of the lighting can. Each spring clip may include a can engaging portion configured to couple to the exterior surface of the lighting can, a retainer clip engaging portion extending outwardly with respect to the can engaging portion, a fixture engaging portion configured to engage a portion of the ceiling ring, wherein the fixture engaging portion is angled upwardly with respect to the retainer clip engaging portion, and a hook portion configured to engage a portion of the ceiling ring, wherein the hook portion extends outwardly and downwardly with respect to the fixture engaging portion. The method further may include coupling at least one of retainer clip to each spring clip with at least one coupling mechanism, wherein each retainer clip is coupled to the retainer clip engaging portion of each spring clip.

These and other features and advantages are evident from the following description of the present invention, with reference to the accompanying drawings.

DETAILED DESCRIPTION OF THE ILLUSTRATED EMBODIMENTS

1. Can System 10

Figure 1:
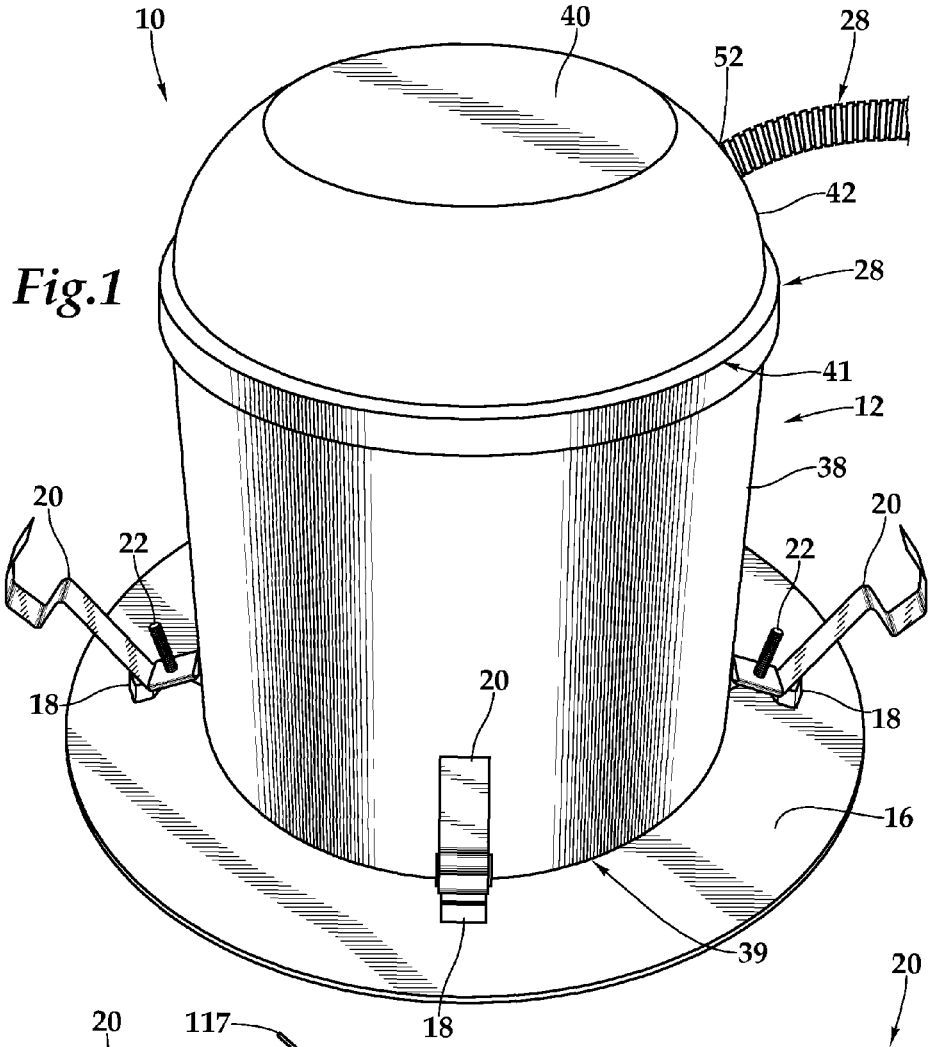
FIG. 1 is a perspective view of a lighting can system.

Turning to at least FIGS. 1-7C, one embodiment of a lighting can system 10 is shown. System 10 is for retrofitting or replacing an existing can system within a ceiling or substrate that may have a ceiling panel 8 is described. Turning to FIGS.

1 and 4, system 10 may include a plurality of components, such as a lighting can 12, a lamp 14, at least one conversion trim ring 16, at least one retainer clip 18, at least one spring clip 20, a plurality of bolts, screws or coupling mechanisms 22, and at least one mounting mechanism or spring 24. Additionally, system 10 may include a power cord 28 coupled to and extending therefrom.

Figure 4:
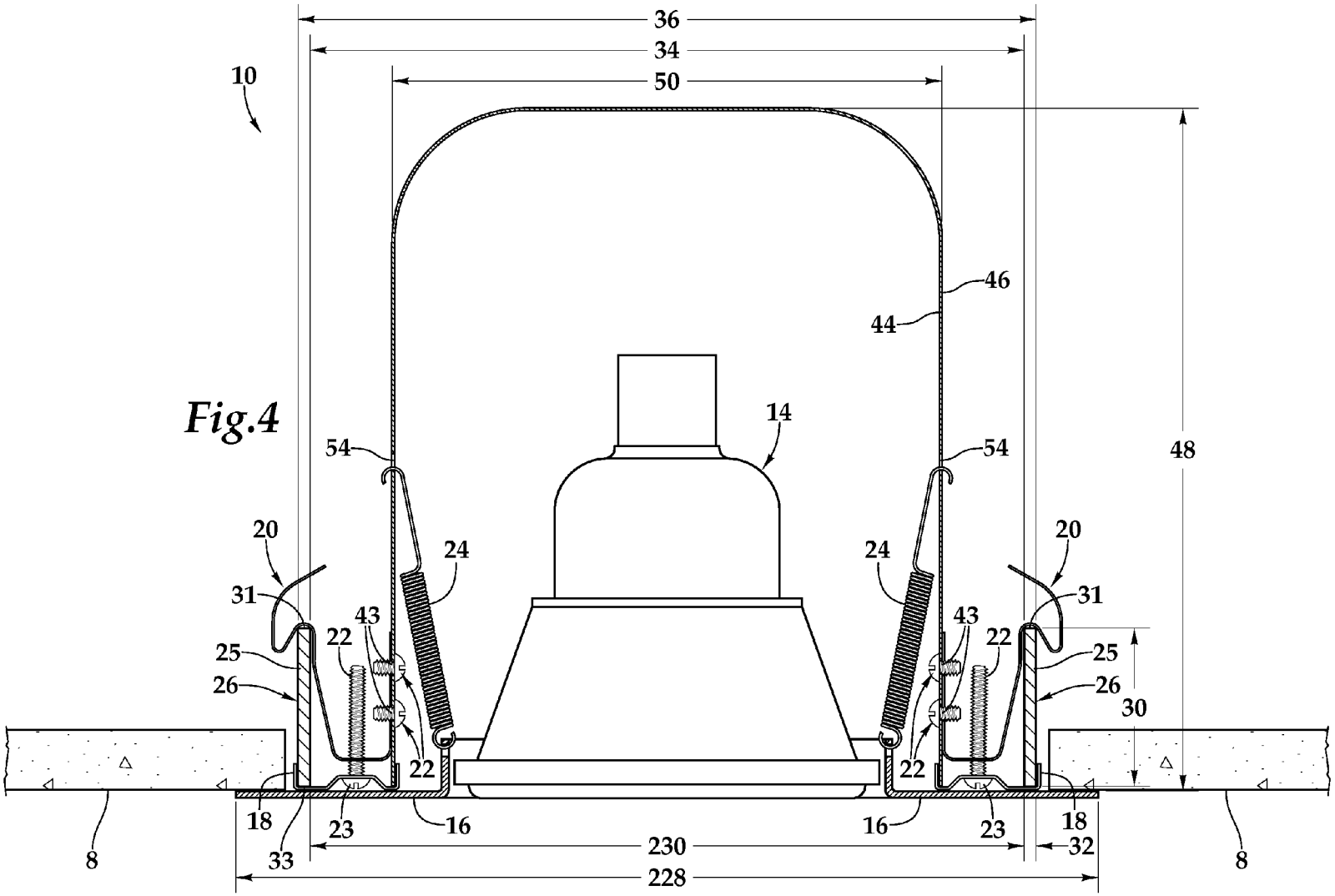
FIG. 4 is a cross-sectional view of the system of FIG. 1.

Continuing with FIG. 4, an existing can system may be removed from the ceiling such that an existing fixture ceiling ring 26, shown in FIG. 6, may remain coupled within ceiling and to ceiling panel 8. Ceiling ring 26 may be a ring having a height 30 between a top edge 31 and a bottom edge 33, a thickness 32 substantially defined between an inner diameter 34 and an outer diameter 36, such that diameter 36 may be greater than diameter 34. Height 30 may be between about 0.5" and about 5.5", preferably between about 1" and about 3", and in one embodiment, about 1.5", and thickness 32 may be between about 0.15" and about 1", preferably between about 0.25" and about 0.75", and in one embodiment, about 0.5". Additionally, outer diameter 36 may be between about 3" and about 20", preferably between about 6" and about 15", and in one embodiment, about 8.25". Alternatively, ring 26 may have any suitable size or shape.

1.1 Lighting Can 12 and Lamp 14

Returning to FIG. 1, lighting can 12 may be configured to be installed into a ceiling, wherein can 12 is inserted upwards into the ceiling. Lighting can 12 may be a single unitary part, as shown in FIG. 4. For example, as shown in FIG. 4, lighting can 12 may have a continuous sidewall portion 38 extending between a first end 39 and a second end 41, and further may include an end portion 40 extending from sidewall portion 38 via a bend 42. Alternatively, lighting can 12 may have a plurality of parts, as shown in FIG. 1. For example, lighting can 12 may have a sidewall portion 38 and a separate end portion 40 that is coupled to sidewall portion 38, proximate second end 41.

In either example, lighting can 12 may have a height 48 and a diameter 50, shown in FIG. 4. Preferably, diameter 50 may be less than outer diameter 36 of ceiling panel 8. Height 48 may be between about 2" and about 12", preferably between about 3" and about 10", and in one embodiment, about 8", and diameter 50 may be between about 1" and about 18", preferably between about 3" and about 12", and in one embodiment, about 6". Alternatively, can 12 may have any suitable size or shape that facilitates operation of system 10.

Additionally, as shown in FIG. 4, lighting can 12 may include an interior surface 44 and an exterior surface 46. Returning to FIG. 1, lighting can 12 further may include an opening 52 therein, wherein power cord 28 may extend therethrough, such that power cord 28 may be coupled to a power source (not shown). In one embodiment, opening 52 is within end portion 40. Also, as shown in FIG. 4, lighting can 12 may include a plurality of openings 54 therein, such that each opening 54 may be configured to receive a portion of a mounting spring therein. Moreover, as shown in FIG. 4, lighting can 12 may include a plurality of openings 43 therein, such that each opening 34 may be configured to receive at least a portion of a bolt 22 or bolthead 23 therein.

Moreover, in one embodiment, lighting can 12 is configured to receive a plate and a socket (not shown) to facilitate coupling lamp 14 within lighting can 12. Lamp 14 may be configured to couple to the socket, wherein the socket holds lamp 14 within lighting can 12. The plate and socket also may include a plurality of wires coupled thereto, wherein the wires may be coupled to the power source to facilitate powering lamp 14.

1.2 Retainer Clip 18

Figure 2:
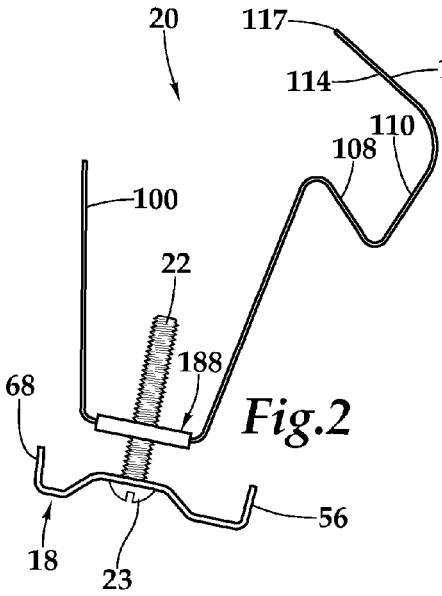
FIG. 2 is a side view of a sub-assembly of the system of FIG. 1.
Figure 6A:
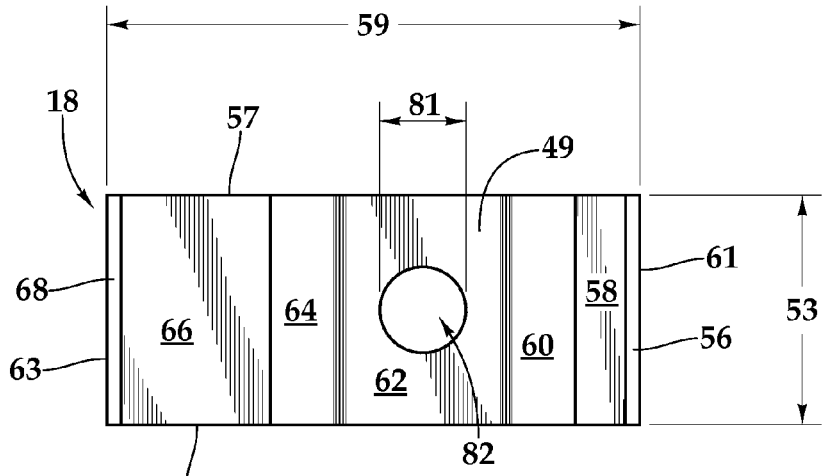
FIG. 6A is a side view of a retainer clip of the sub-assembly of FIG. 2.

Turning to FIGS. 2 and 6A, system 10 may include a plurality of retainer clips 18. Each clip 18 may be configured to facilitate coupling lighting can 12 and ring 26. Each clip 18 may include a plurality of portions, such as a can interior engaging portion 56, a first trim engaging portion 58, a first height portion 60, a bolt engaging portion 62, a second height portion 64, a second trim engaging portion 66, and a fixture engaging portion 68. Each retainer clip 18 may be fabricated from #22 galvanized sheet steel. Alternatively, clip 18 may be fabricated from any suitable material that facilitates operation of the same. For example, clip 18 may be fabricated from aluminum and/or a plastic material. Moreover, each clip 18 may have an interior surface 49 and an exterior surface 51.

Figure 6B:
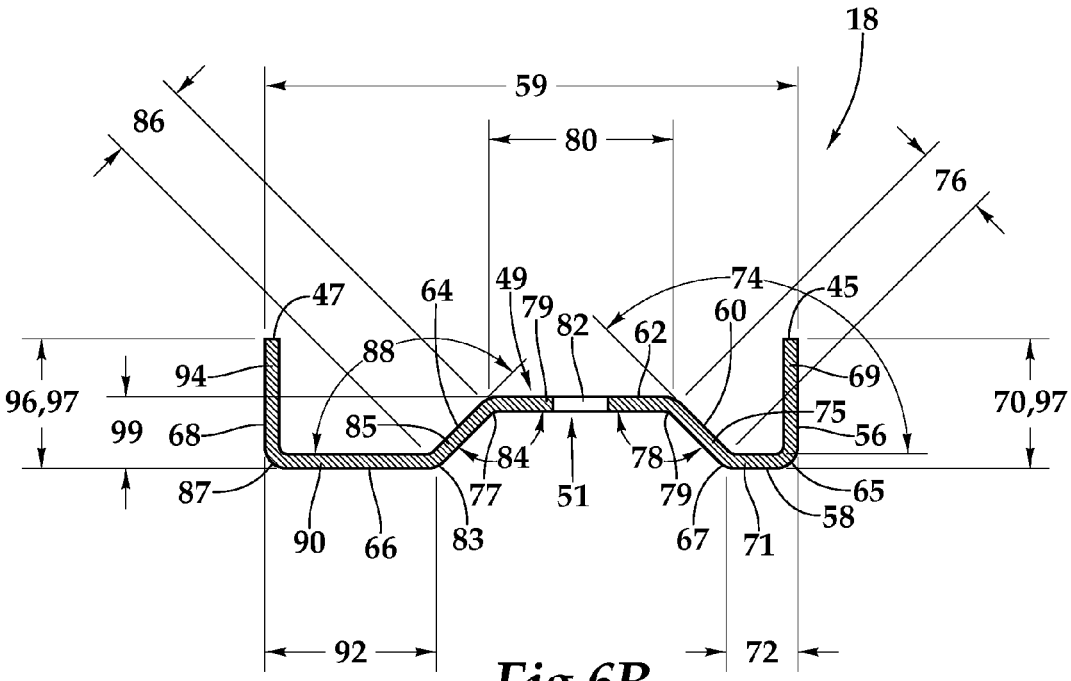
FIG. 6B is a front view of a retainer clip of FIG. 5B.

Turning to FIG. 6B, each clip 18 generally may have a can engaging end 45 and a fixture end 47. Also, each clip 18 may have a generally constant width 53 between a first side edge 55 and a second side edge 57, and may have a length 59 between a first end 61 and a second end 63. Width 53 may be between about 0.05" and about 3", preferably between about 0.25" and about 1", and in one embodiment, about 0.5", and length 59 may be between about 0.25" and about 5", preferably between about 0.5" and about 2.5", and in one embodiment, about 1". In one embodiment, width 53 is about ½".

Can interior engaging portion 56 may be configured to engage interior surface 44 of lighting can 12. In one embodiment, can interior engaging portion 56 has a straight part 69 that has a length 70. Length 70 may be between about 0.05" and about 2", preferably between about 0.1" and about 1", and in one embodiment, about 0.28". In one embodiment, length 70 is about ¼".

Turning to FIG. 6A, first trim engaging portion 58 may be configured to engage a surface of trim ring 16. In one embodiment, first trim engaging portion 58 is substantially normal via a bend 65 to can interior engaging portion 56 and extends outwardly therefrom, and further has a straight part 71 with a length 72. Length 72 may be between about 0.05" and about 1", preferably between about 0.075" and about 0.5", and in one embodiment, about 0.1". In one embodiment, length 72 is about ⅛".

Continuing with FIG. 6A, first height portion 60 may be configured to raise bolt engaging portion 62 a distance above trim ring 16. In one embodiment, first height portion 60 is angled upwardly and outwardly at an angle 74 via a bend 67 with respect to straight part of first trim engaging portion 58 and further has a straight part 75 with a length 76. Angle 74 may be between about 105 degrees and about 175 degrees, preferably between about of about 120 degrees and 150 degrees, and in one embodiment, about 135 degrees, and length 76 may be between about 0.05" and about 2", preferably between about 0.1" and about 1", and in one embodiment, about 0.2". In one embodiment, length 76 is about ¼".

Bolt engaging portion 62 may be configured to facilitate coupling clips 18 and 20 together. In one embodiment, bolt engaging portion 62 extends outwardly at an angle 78 via a bend 73 with respect to first height portion 60 and further has a straight part 79 with a length 80. Angle 78 may be between about 105 degrees and about 175 degrees, preferably between about of about 120 degrees and 150 degrees, and in one embodiment, about 135 degrees, and length 80 may be between about 0.1" and about 2", preferably between about 0.1" and about 1", and in one embodiment, about 0.4". In one embodiment, length 80 is about ⅜".

Returning to FIG. 6B, bolt engaging portion 62 may include an opening 82, such that opening 82 is configured to receive a bolt 22 therein, wherein bolt 22 is configured to couple bolt engaging portion 62 to a retainer clip engaging portion of spring clip 20. Opening 82 may be generally centered within bolt engaging portion 62. In one embodiment, the center of opening 82 is positioned about ¼" from either edge 55 or 57, and the center of opening 82 is positioned about ½" from edge 61. Alternatively, opening 82 may be positioned at any location within portion 62. Opening 82 further may have a diameter 81 between about 0.05" and about 2", preferably between about 0.1" and about 1", and in one embodiment, about 0.2". In one embodiment, diameter 81 is about ¼".

Returning to FIG. 6A, second height portion 64 may be configured to raise bolt engaging portion 62 a distance above trim ring 16. In one embodiment, portion 64 extends outwardly and downwardly at an angle 84 via a bend 77 with respect to portion 62 and further has a straight part 85 with a length 86. Angle 84 may be between about 105 degrees and about 175 degrees, preferably between about of about 120 degrees and 150 degrees, and in one embodiment, about 135 degrees, and length 86 may be between about 0.05" and about 2", preferably between about 0.1" and about 1", and in one embodiment, about 0.2". In one embodiment, length 86 is about ¼".

Continuing with FIG. 6A, second trim engaging portion 66 may be configured to engage a surface of trim ring 16. In one embodiment, second trim engaging portion 66 extends outward at an angle 88 via a bend 83 with respect to portion 64 and further has a straight part 90 with a length 92. Angle 88 may be between about 105 degrees and about 175 degrees, preferably between about of about 120 degrees and 150 degrees, and in one embodiment, about 135 degrees, and length 92 may be between about 0.05" and about 1", preferably between about 0.075" and about 0.5", and in one embodiment, about 0.1". In one embodiment, length 92 is about ⅛".

As shown in FIG. 6A, fixture engaging portion 68 may be configured to engage a surface of ring 26. In one embodiment, portion 68 is substantially normal via a bend 87 to portion 66 and extends upwardly therefrom, and further has a straight part 94 with a length 96. Length 96 may be between about 0.05" and about 2", preferably between about 0.1" and about 1", and in one embodiment, about 0.28". In one embodiment, length 70 is about ¼".

In one embodiment, retainer clip 18 generally may be about 1" long and may have an engaging portion, such as portions 56 and 68, on each end, such as ends 45 and 47. Each end 45 and 47 may be configured to facilitate securing clip 18 to can 12 and ring 26. Clip 18 further may include a projection or offset 98 between each end, wherein the projection 98 may include an opening therein, wherein the opening may be configured to receive a bolt 22 and a bolthead 23. Specifically, the bolt head 23 may be coupled proximate to exterior surface 51 of clip 18. Projection 98 may be offset between ends 45 and 47 such that, in one embodiment, projection 98 is closer to end 45 than to end 47. Additionally, projection 98 may be configured to elevate bolthead 23 a distance or height 99 above trim ring 16 and/or from surfaces 58 ad 66, such that bolthead 23 will not interfere with coupling trim ring 16 to system 10. Distance 99 may be between about 0.05" and about 0.3", preferably between about 0.1" and about 0.2", and in one embodiment, about 0.13". Moreover, in one embodiment, each end 45 and 47 has a height 97, wherein height 97 may be greater than height 99 of projection 98.

1.3 Spring Clip 20

Figure 3:
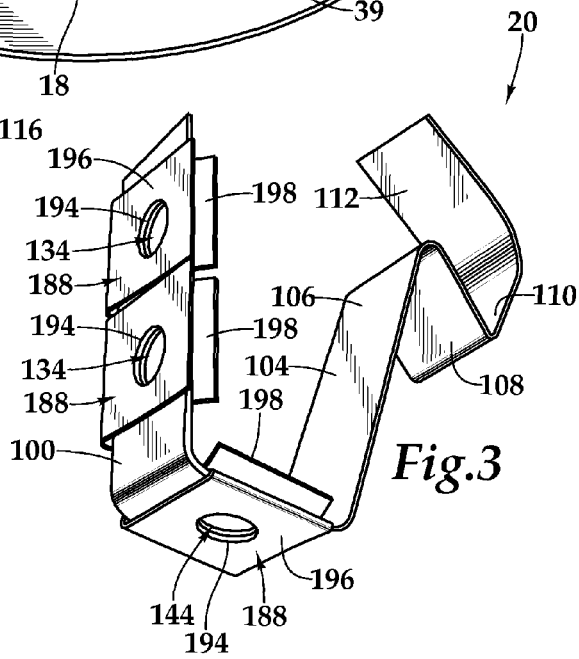
FIG. 3 is a perspective view of a retainer clip of sub-assembly of FIG. 2.
Figure 5A:
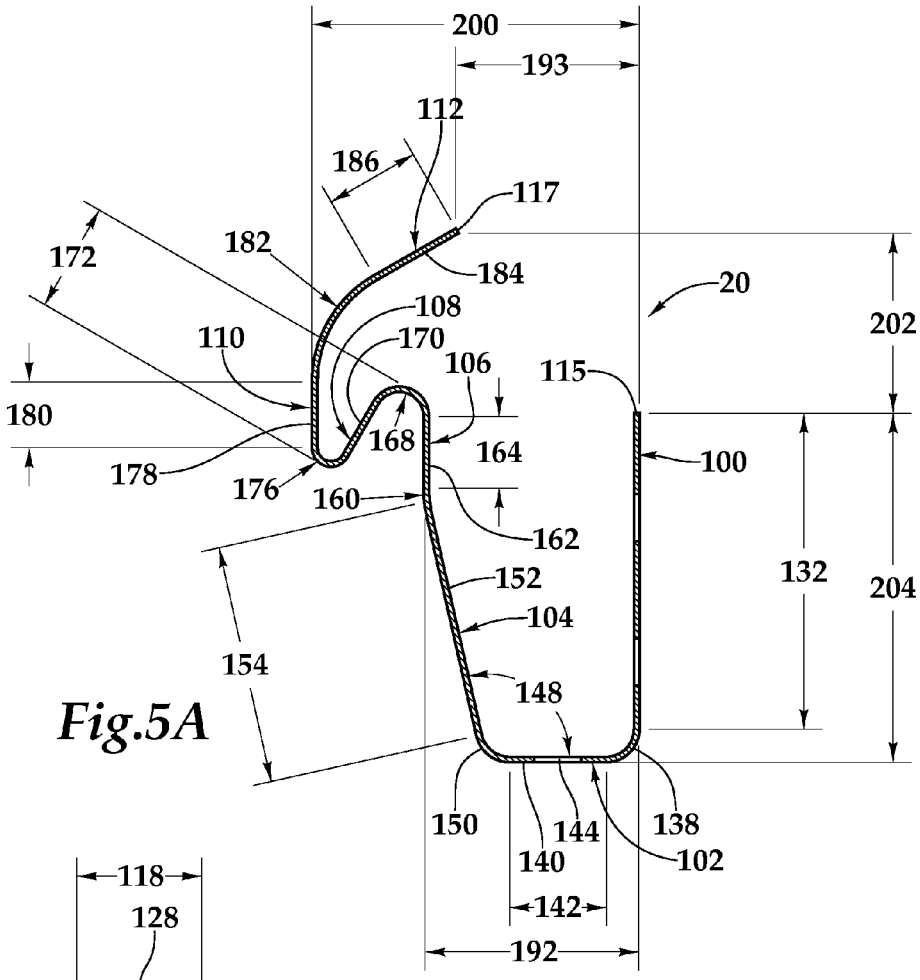
FIG. 5A is a side view of a spring clip of the sub-assembly of FIG. 2.
Figure 5B:
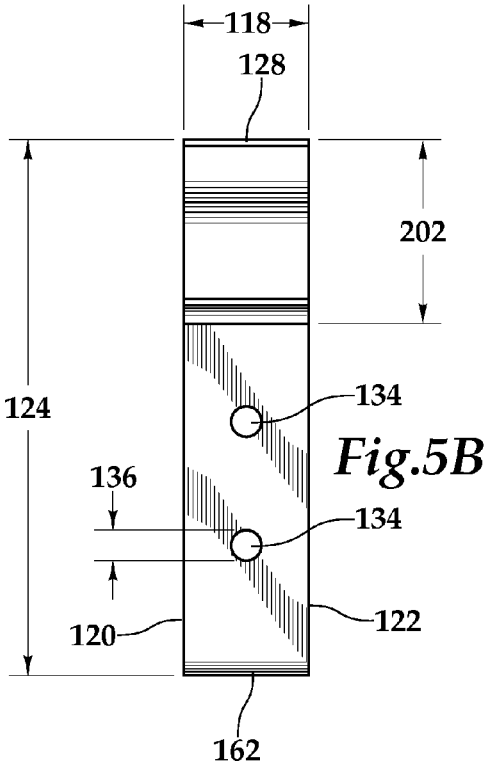
FIG. 5B is a front view of the spring clip of FIG. 5A.
Figure 5C:
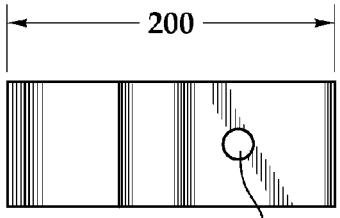
FIG. 5C is a bottom view of a spring clip of FIG. 5A.

Turning to FIGS. 2, 3 and 5, system 10 may include a plurality of spring clips 20. Each clip 20 may be configured to further facilitate coupling lighting can 12 and ring 26. Each clip 20 further facilitates easy removal of the coupling between lighting can 12 and ring 26. Each clip 20 may include a plurality of portions, such as a can exterior engaging portion 100, a retainer clip engaging portion 102, a connecting portion 104, a fixture engaging portion 106, a hook portion 108, a spacing portion 110, and a leading portion 112. Each spring clip 20 may be fabricated from 0.015 THK spring steel. Alternatively, clip 20 may be fabricated from any suitable material that facilitates operation of the same. For example, clip 20 may be fabricated from any spring steel, aluminum and/or a plastic material. Moreover, each clip 20 may have an interior surface 114 and an exterior surface 116.

As shown in FIG. 2, each clip 20 generally may have a can engaging end 115 and a fixture end 117. As shown in FIG. 5B, each clip 20 may have a generally constant width 118 between a first side edge 120 and a second side edge 122, and may have an overall height 124 between a first end 126 and a second end 128. Width 118 may be between about 0.05" and about 3", preferably between about 0.25" and about 1", and in one embodiment, about 0.5", and height 124 may be between about 0.25" and about 5", preferably between about 0.5" and about 2.5", and in one embodiment, about 1". In one embodiment, width 118 is about ½".

Continuing with FIG. 5A, can exterior engaging portion 100 may be configured to engage exterior surface 46 of lighting can 12. In one embodiment, can exterior engaging portion 100 has a straight part 130 that has a length 132. Length 132 may be between about 0.1" and about 5", preferably between about 1" and about 3", and in one embodiment, about 1.25". In one embodiment, length 132 is about 1¼".

Additionally, length 132 of portion 100 of clip 20 may be less than height 30 of ring 26. Alternatively, length 132 may be substantially the same as or greater than height 30. In one embodiment, length 132 is slightly less than height 204. Alternatively, length 132 may be any suitable height.

Turning to FIG. 5B, can exterior engaging portion 100 may also include a plurality of openings 134, such that each opening 134 is configured to receive a bolt 22 therein, wherein bolt 22 is configured to couple bolt portion 100 to exterior surface 46 of lighting can 12. Each opening 134 may be generally centered within portion 100, such that the center of each opening 134 may be positioned about ¼" from either edge 120 or 122. In one embodiment, the center of a first opening 134 is positioned about ⅜" from end 115 and the center of a second opening 134 is positioned about 0.9" from end 118. Alternatively, each opening 134 may be positioned at any location within portion 100. Each opening 134 further may have a diameter 136 between about 0.05" and about 2", preferably between about 0.1" and about 1", and in one embodiment, about 0.125". In one embodiment, diameter 136 is about ⅛".

Returning to FIG. 5A, retainer clip engaging portion 102 may be configured to facilitate coupling portions 18 and 20 together. In one embodiment, retaining clip engaging portion 112 is substantially normal via a radius 138 to can exterior engaging portion 100 and extends outwardly therefrom, and further has a straight part 140 with a length 142. Length 142 may be between about 0.05" and about 1", preferably between about 0.075" and about 0.5", and in one embodiment, about 0.1". In one embodiment, length 142 is about ⅜". Radius 138 may be between about 0.05 and about 0.75, preferably between about 0.1 and about 0.5, and in one embodiment, about 0.125. In one embodiment, radius 138 is about ⅛.

As shown in FIG. 5B, in one embodiment, portion 102 may include an opening 144, such that opening 144 is configured to receive a bolt 22 therein, wherein bolt 22 is configured to couple 102 to portion 62 of retainer clip 18. Opening 144 may be offset between portions 100 and 104, i.e., such that opening 144 may not be centered between portions 100 and 104. In one embodiment, the center of opening 144 is positioned about ⅜" from portion 100 and the center of opening 144 is positioned about ¼" from either edge 120 or 122. Alternatively, opening 144 may be positioned at any location within portion 102. Opening 144 further may have a diameter 146 between about 0.05" and about 2", preferably between about 0.1" and about 1", and in one embodiment, about 0.125". In one embodiment, diameter 136 is about ⅛".

As shown in FIG. 5A, connecting portion 104 may connect portion 102 to a portion 106. In one embodiment, portion 104 extends upwardly and outwardly at an angle 148 with respect to straight part 140 of portion 102 via a radius 150 and further has a straight part 152 with a length of about 154. Angle 148 may be between about 80 degrees and about 175 degrees, preferably between about of about 100 degrees and 125 degrees, and in one embodiment, about 103 degrees. Angle 154 may facilitate compressing clip 20 from an idle position to an engaged position, such that clip 20 in an engaged positioned may be coupled to can 12 and ring 26. Radius 150 may be between about 0.05 and about 0.75, preferably between about 0.1 and about 0.5, and in one embodiment, about 0.13. In one embodiment, radius 150 may be about ⅛. Length 154 may be between about 0.25" and about 4", preferably between about 0.5" and about 2", and in one embodiment, about 1".

In alternative embodiments, portions 102 and 104 may have any shape that facilitates coupling portions 100 and 106 together, while still facilitating coupling clip 20 with ring 26 and can 12.

Continuing with FIG. 5A, fixture engaging portion 106 may be configured to engage a portion of fixture ring 26. Specifically, portion 106 may engage the interior surface of ring 26. In one embodiment, portion 106 is angled upwardly at an angle 156 with respect to straight part 152 of connecting portion 104 via a radius 160. Portion 106 further may include a straight part 162 with a length 164. Angle 156 may be between about 80 degrees and about 225 degrees, preferably between about of about 100 degrees and 200 degrees, and in one embodiment, about 167 degrees, and radius 160 may be between about 0.05 and about 0.75, preferably between about 0.075 and about 0.5, and in one embodiment, about 0.1. In one embodiment, radius 160 is about ¼. Also, length 164 may be between about 0.1" and about 1", preferably between about 0.2" and about 0.75", and in one embodiment, about 0.3".

Continuing with FIG. 5A, hook portion 108 may be configured to engage a portion of fixture ring 26. Specifically, in one embodiment, portion 108 may engage an exterior surface 25 of ring 26. Further, if portions 106 and 108 engage interior and exterior surfaces of ring 26, respectively, then radius 160 may engage top edge 31 of portion 31. In one embodiment, portion 108 may extend outwardly and downwardly at an angle 166 via a radius 168 with respect to part 162 of portion 106. Portion 108 further may have a straight part 170 having a length 172. Angle 166 may be between about 5 degrees and about 85 degrees, preferably between about of about 20 degrees and 60 degrees, and in one embodiment, about 30 degrees, and radius 168 may be between about 0.05 and about 0.75, preferably between about 0.075 and about 0.5, and in one embodiment, about 0.1. Also, length 172 may be between about 0.1" and about 1", preferably between about 0.2" and about 0.75", and in one embodiment, about 0.25". In one embodiment, length 172 is about ¼".

Continuing with FIG. 5A, spacing portion 110 may connect portion 108 to portion 112. In one embodiment, spacing portion 110 extends upwardly at an angle 174 via a radius 176 with respect to straight part 170 of hook portion 108. Spacing portion 110 further may have a straight part 178 with a length 180. Angle 174 may be between about 5 degrees and about 85 degrees, preferably between about of about 20 degrees and 60 degrees, and in one embodiment, about 30 degrees, and radius 176 may be between about 0.05 and about 0.75, preferably between about 0.075 and about 0.5, and in one embodiment, about 0.06. Also, length 180 may be between about 0.1" and about 1", preferably between about 0.2" and about 0.75", and in one embodiment, about 0.25". In one embodiment, length 180 is about ¼".

Moreover, in one embodiment, portions 106, 108 and 110 generally form an s-shape. The s-shape may extend between portions 104 and portions 112. Also, a distance 192 may be defined between a portion 100 and a portion 106. Distance 192 may be between about 0.25" and about 1.5", preferably between about 0.5", and about 1" and in one embodiment, about 0.9".

Further, in one embodiment, a distance 193 may be defined between portion 100 and clip end 117. In one embodiment, distance 193 is less than distance 192. Further, distance 193 may be less than width 200.

Continuing with FIG. 5A, leading portion 112 may be configured to facilitate leading and/or guiding a portion of clip 20 to engage ring 26 and further may prevent portion 112 from getting caught on edge 33 of ring 26. In one embodiment, leading portion 112 extends upwardly and inwardly via a radius 182 with respect to part 178 of spacing portion 110. Portion 112 further may have a straight part 184 with a length 186. Radius 182 may be between about 0.05 and about 0.75, preferably between about 0.1 and about 0.5. Length 186 may be between about 0.1" and about 2", preferably between about 0.1" and about 1", and in one embodiment, about 0.4". In one embodiment, length 186 is about ⅜".

Additionally, a plurality of washers or nuts 188 may be configured to couple to spring clip 20, such that each washer 188 may be configured to facilitate coupling bolts 22 to clip 20, such that each washer 188 further may facilitate engaging threads of bolts 22. In one embodiment, three washers 188 are coupled to spring clip 20, wherein a first washer is coupled to portion 102, and a second and third washer are each coupled to portion 100. Each washer 188 may include an opening 194 that may be generally sized to be about the same size, i.e., have the same diameter, as openings 134 and/or opening 144. In one embodiment, at least one opening 194 is configured to be aligned and/or concentric with at least one opening 134 and/or at least one opening 144.

Each washer 188 may include a coupling surface 196 and at least one flap portion 198 coupled thereto. In one embodiment, coupling surface 196 is configured to couple to a portion of exterior surface 116 of clip 20 and the at least one flap portion 198 is configured to couple to a portion of interior surface 114 of clip 20 and/or at least one edge, such as an edge 120 or 122, of clip 20.

Moreover, clip 20 may have an overall width 200. Width 200 may be defined between portion 110 and portion 100. In one embodiment, width 200 is between about 0.5" and about 6", preferably between about 1" and about 3", and in one embodiment, about 1.3". Also, in one embodiment, width 200 of spring clip 20 is greater than length 59 of retainer clip 18, such that when clip 20 is coupled between ring 26 and can 12, clip 20 may be compressed between ring 26 and can 12.

In one embodiment, clip end 117 may extend inward of portion 106. Additionally, a height 202 may be defined between clip end 115 and clip end 117, wherein end 117 is upward of end 115. Height 202 may be between about 0.25" and about 2", preferably between about 0.5" and about 1", and in one embodiment, about 0.75".

Generally, clip 20 may be about 1.32" long and may have an engaging portion on each end, such as can engaging portion 100 and a guiding portion 208. Guiding portion 208 may include portions 110 and 112. Guiding portion 208 may be configured to guide clip 20, such that when coupling clip 20 to can 12 and ring 26, portions 108, 110, and 112 do not get caught beneath ring 26. In one embodiment, guiding portion 208 is positioned upward of portion 100. Additionally, guiding portion 208 may also be configured to facilitate removal of clip 20, such that a user may press inwardly on guiding portion 208 to disengage portions 106 and 108 from ring 26.

1.4 Plurality of Bolts, Screws or Coupling Mechanisms 22

Turning to FIG. 2, system 10 may further include a plurality of coupling mechanisms. In one embodiment, bolts 22 configured to couple portion of system 10 together. Each bolt 22 may include a threading portion 21 and bolthead 23. In one embodiment, a bolt 22 having a first length is configured to couple portion 62 to portion 102, and at least two bolts 22 having a second length are configured to couple portion 100 to can 12. In one embodiment, first length is less than second length. Alternatively, first length may be substantially the same as or greater than the second length.

1.5 Trim Ring 16

Figure 7A:
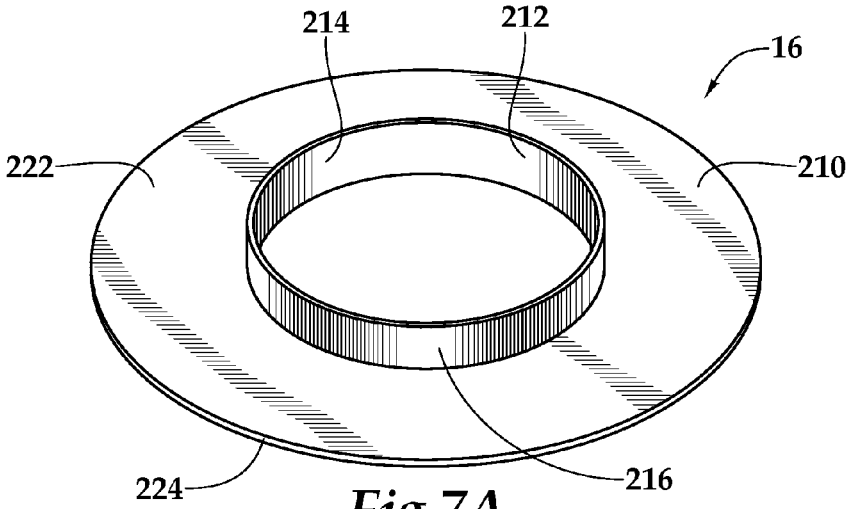
FIG. 7A is a perspective view of a trim ring of the system of FIG. 1.
Figure 7B:
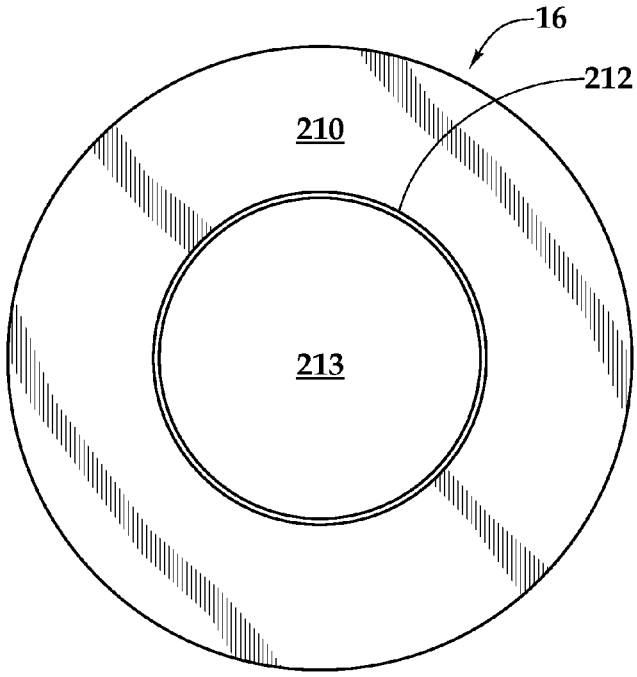
FIG. 7B is a front view of the trim ring of FIG. 7A.
Figure 7C:
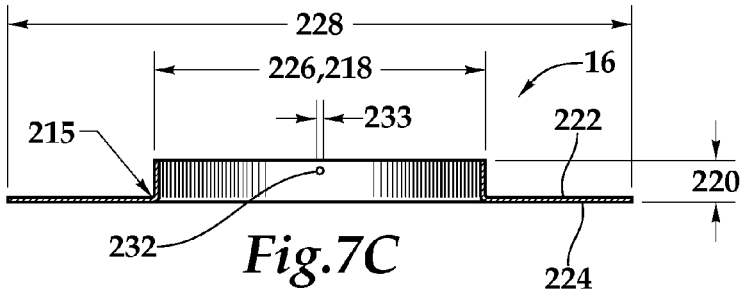
FIG. 7C is a cross-sectional view taken along line A-A of the trim ring of FIG. 7A.

Turning to FIGS. 7A-7C, system 10 also may include a trim ring 16. Trim ring 16 may include a trim portion 210 and a flange portion 212 and an opening 213 therein. In one embodiment, trim portion 210 is configured to couple proximate to retainer clip 18 and ceiling panel 8, and flange portion 212 is configured to couple proximate to lamp 14. Moreover, in one embodiment, trim ring 16 is fabricated from #18 galvanized sheet steel in a 0.0478 thickness. Trim ring 16 may be fabricated from a material that can withstand a high heat without deformation. Alternatively, trim ring 16 may be fabricated from any type of sheet steel, metal, aluminum, and/or plastic material. Additionally, trim ring 16 may include a powder coat paint on it to match the color of ceiling panel 8. For example, the paint may be a white satin.

As shown in FIG. 7A, trim portion 210 may include an interior surface 222 and an exterior surface 224, and an inner diameter 226 and an outer diameter 228. In one embodiment, interior surface 222 is configured to couple to a portion of retainer clip 18, and exterior surface 226 is configured to provide a decorative element to hide the clips and connections between can 12 and ring 28. Diameter 226 may be sized such that diameter 226 may be greater than a diameter of a lamp 14, and diameter 228 may be sized such that diameter 228 may be greater than diameter of ring 26 and/or a diameter 231 of an existing ceiling opening 230. Diameter 226 may be between about 1" and about 10", preferably between about 3" and about 8", and in one embodiment, about 4.8". Diameter 228 may be between about 1.5" and about 20", preferably between about 5" and about 10", and in one embodiment, about 9.5". Diameter 231 may be between about 3" and about 20", preferably between about 6" and about 15", and in one embodiment, about 8.25".

As shown in FIG. 7C, flange portion 212 may facilitate coupling trim ring 16 to can 12. In one embodiment, flange portion 212 is substantially normal via a radius 215 to trim portion 210 and extends upward therefrom. Flange portion 212 may include an interior surface 214 and an exterior surface 216, and a diameter 218 having a height 220, and at least one opening 232 therein. Surfaces 214 and 216 may be configured to be coupled proximate lamp 14. Diameter 218 may be between about 1" and about 10", preferably between about 3" and about 8", and in one embodiment, about 4.8". In one embodiment, diameters 218 are diameter 226 are generally the same size. Radius 215 may be between about 0.01 and about 0.5, preferably between about 0.025 and about 0.3, and in one embodiment, about 0.05.

In one embodiment, flange portion 212 includes two openings 232, wherein each opening 232 is diametrically opposite the other. Moreover, each opening 232 may be configured to engage at least one mounting mechanism 24. As shown in FIG. 7C, opening 232 may have a diameter 233, wherein diameter 233 may be about 0.110". Alternatively, flange portion 212 may have any number of openings 232, and diameter 233 may be any suitable size.

1.6 Mounting Mechanism 24

Turning to FIG. 4, system 10 further may include a plurality of mounting mechanisms or springs 24. Each mounting spring 24 is configured to facilitate coupling trim ring 16 to can 12, such that trim ring 16 may cover the space between can 12 and the existing opening in ceiling panel 8. Each mounting spring 24 may include at least one hook portion 234 and a spring portion 236 coupled thereto. In one embodiment, spring portion 236 may include two hook portions 234, one on a first end of spring portion 236 and another on a second end of spring portion 236. Each hook portion 234 is configured to extend substantially between ring 16 and can 12. In one embodiment, a first hook is configured to engage opening 54 in can 12 and a second hook is configured to engage opening 232 in trim ring 16. Alternatively, mounting springs 24 may be a spring clip or a scissor clip.

Mechanisms 24 are configured to enable trim ring 16 to be able to shift and/or moved into a position that may sufficiently cover and/or hide the opening between lighting can 12 and the existing ceiling opening.

2. Assembly with System 10

System 10 may be assembled and/or installed through a plurality of steps. Before retrofitting an existing lighting system with a replacement lighting system, the existing lighting system needs to be removed. Preferably, the existing lighting system is removed downward through an opening 238 in ceiling panel 8. In one embodiment, existing fixture ceiling ring 26 from existing lighting system remains coupled above ceiling panel 8.

In one embodiment, system 10 is at least partially assembled prior to insertion into the ceiling. For example, system 10 may be assembled on the ground rather than assembled in the ceiling. Alternatively, system 10 may be assembled in the ceiling.

To assemble system 10, any number of clips 20 may be coupled to can 12. In one embodiment, four clips 20 are coupled to exterior surface 46 of can 12. In one embodiment, exterior surface 116 of each clip 20, including at least one washer 188, is coupled to exterior surface 46 of can 12. When each clip 20 is proximate can 12, at least one bolt 22 may be inserted through openings 43 and 134. The at least one bolthead 23 may be proximate interior surface 44 of can 12. Bolt 12 may then be tightened to facilitate anchoring and/or coupling spring clip 20 to can 12.

Each clip 20 may have a retainer clip 18 configured to couple thereto. As shown in FIG. 2, at least one clip 18 may be coupled to at least one clip 20. In one embodiment, interior surface 49 of clip 18 is positioned proximate to exterior surface 116 of portion 102 of clip 20. Also, in one embodiment, at least one opening 82 may be aligned with at least one opening 144 such that the openings are concentric. Additionally, in one embodiment, end 45 of clip 18 is proximate portion 100, and end 47 of clip 18 is proximate portion 104. At least one bolt 22 may be inserted through the at least one opening 82 in clip 18 and through the at least one opening 144 and/or washer 188 in clip 20, such that bolthead 23 may engage exterior surface 51 of portion 62 of clip 18. When coupling clip 18 to clip 20, a distance 240 may be positioned between portions 62 and 102. Additionally, when clip 18 is assembled to clip 20 prior to insertion of can 12 into the ceiling, clip 18 should remain loose and/or rotatable around bolt 22, such that bolt 22 may be tightened later to retain clip 18 in an engaged position. Alternatively, clips 18 and clips 20 may be coupled together after can 12 is inserted into ceiling panel 8. In the alternative, when clip 18 is coupled to clip 20 when can 12 is already inserted into the ceiling, clip 18 should not remain loose with respect to clip 20.

Prior to inserting can 12 into ceiling panel 8, power cord 28 may be coupled to a power source. Alternatively, power cord 28 may be coupled to a power source subsequent to inserting can 12 into ceiling panel 8. In one embodiment, a plate and a socket (not shown) is coupled to interior surface 44 of can 12 prior to inserting can 12 into ceiling panel 8.

Can 12 may be inserted into ceiling and/or ceiling panel 8 by inserting can 12 through opening 230. In one embodiment, can 12 is inserted upward such that end 40 enters through opening 230 prior to sidewall 38 entering opening 230. As can 12 is inserted upward, clips 20 may facilitate guiding can 12 into an engaged position, because as clips 20, specifically leading portion 112 and end 117, are pushed upward, leading portion 112 may contact edge 33 of ring 26, and portions 110 and 112 are pushed inward, such that portions 110 and 112 may slide upward past edge 33 of ring 26.

In one embodiment, can 12 is inserted upward until first end 39 is generally co-planar with second end of ring 33 and/or until clip 20 engages ring 26. When at least one clip 20 is coupled between ring 26 and can 12, clip 20 may be compressed between ring 26 and can 12 in an engaged position. In the engaged position, portion 106 may engage interior surface of ring 26 and portion 108 may engage exterior surface 25 of ring 26, and a portion of clip 20 may also engage top edge 31 of ring 26.

Each retainer clip 18, coupled proximate each engaged clip 20, may then be rotated around bolt 22 to a desired position. In one embodiment, each clip 18 may be rotated until end 45 is proximate interior surface 44 of can 12 and until end 47 is proximate exterior surface 25 of ring 26. Bolt 22 may then be tightened to secure can 12 to ring 26. As bolt 22 is tightened, distance 240 between surfaces 62 and 102 may decrease.

Once each clip 18 and each clip 20 are secured in an engaged position around can 12, a trim ring 16 may be coupled to can 12 to cover clips 18 and 20. In one embodiment, trim ring 16 includes two diametrically opposite openings 232 that are configured to receive a portion of mechanisms 24 therein. In one embodiment, to couple trim ring 16 to can 12, at least one end of mounting mechanism 24 is coupled to opening 54 and the other end of mounting mechanism is coupled to opening 232. Trim ring 16 may then be shifted and/or moved to sufficiently cover and/or hide the opening between lighting can 12 and the existing ceiling opening.

Moreover, clips 18 and 20 may easily be removed. In one embodiment, a user may remove trim ring 16, loosen bolt 22 inserted into both clips 18 and 20, reach upward between can 12 and the existing ceiling opening, apply pressure to at least portion 112 of each clip 20 to release each clip 20 from ring 26, and pull can 12 downward through ceiling panel 8.

3. Can System 300

Turning to at least FIGS. 8-11, a lighting can system 300 for retrofitting or replacing a portion of an existing can system is described. System 300 may include a plate 302 and a socket 304 to facilitate coupling a lamp 14 within a lighting can 306, and further may include a plurality of couplings 308 and a plurality of bolts or screws 310. Lamp 14 may be configured to couple to the socket, wherein the socket holds lamp 14 within lighting can 306. Plate 302 and socket 304 also may include a plurality of wires coupled thereto, wherein the wires may be coupled to the power source to facilitate powering lamp 14.

3.1 Can 306

Figure 8:
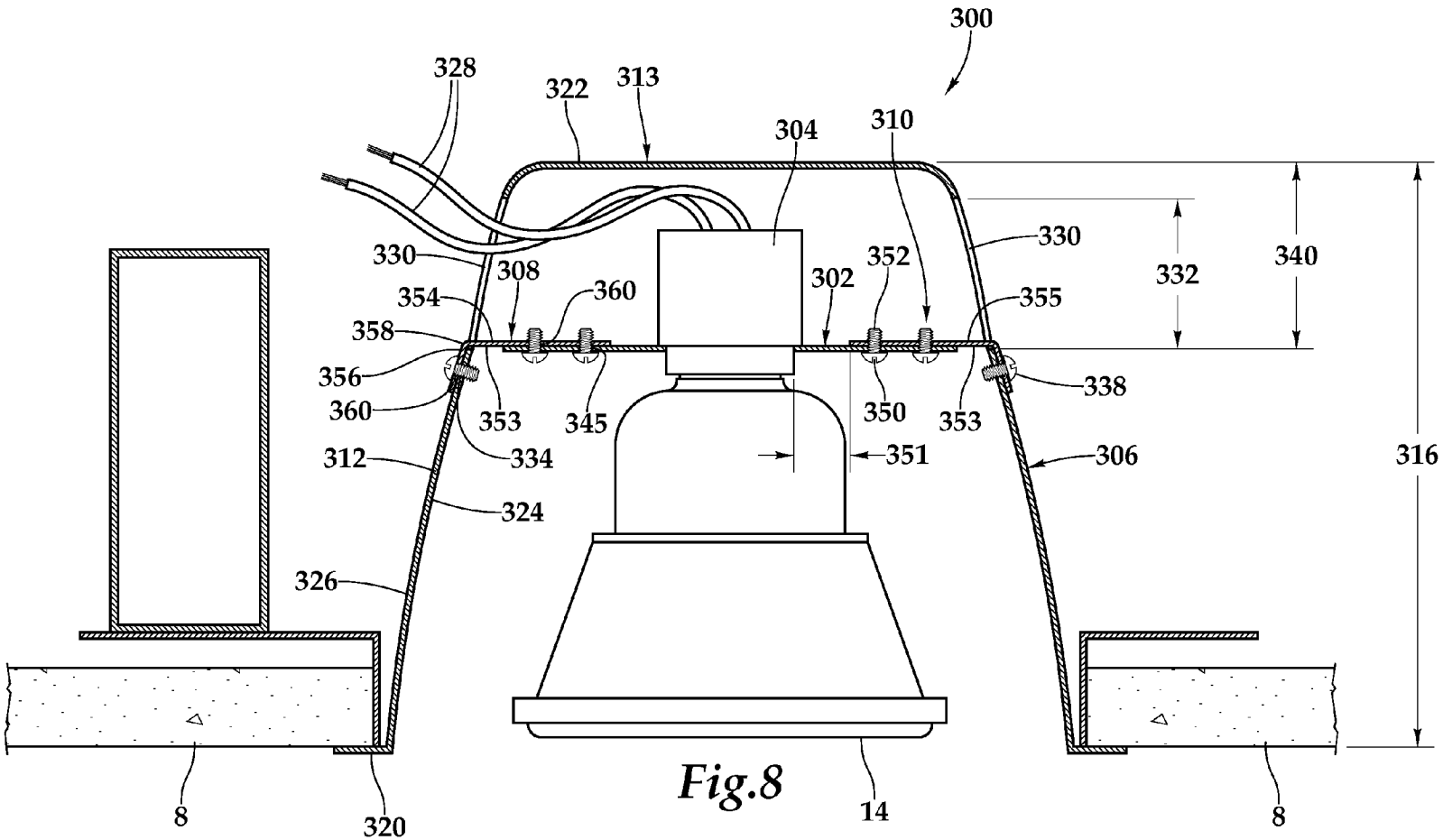
FIG. 8 is a cross-sectional view of a second system.

Turning to FIG. 8, in one embodiment, can 306 may be configured to be installed into a ceiling with a ceiling panel 8, wherein can 306 is inserted upwards into the ceiling, and wherein can 306 may slide in and out of the ceiling. In one embodiment, can 306 is a single unitary part, as shown in FIG. 8. Can 306 may be an existing 8" compact florescent can reflector. Alternatively, can 306 may have any shape and size. In one embodiment, can 306 has a sidewall 312 and an end 313.

Continuing with FIG. 8, can 306 may have a height 316 between a first end 320 and a second end 322 and a varying diameter 318. Can 306 may include an interior surface 324 and an exterior surface 326. Can 306 further may include an opening (not shown) therein, such that wiring leads 328 extend through the opening.

Additionally, can 306 may include a plurality of openings 330 therein, such that each opening 330 may be configured to receive at least a portion of a coupling 308. Opening 330 may have a diameter 332.

Further, can 306 may include a plurality of openings 334. Each opening 334 may be beneath each opening 330. Each opening 334 may have a diameter 336 configured to receive a screw or bolt 310 therein.

3.2 Plate 302 and Socket 304

Figure 9:
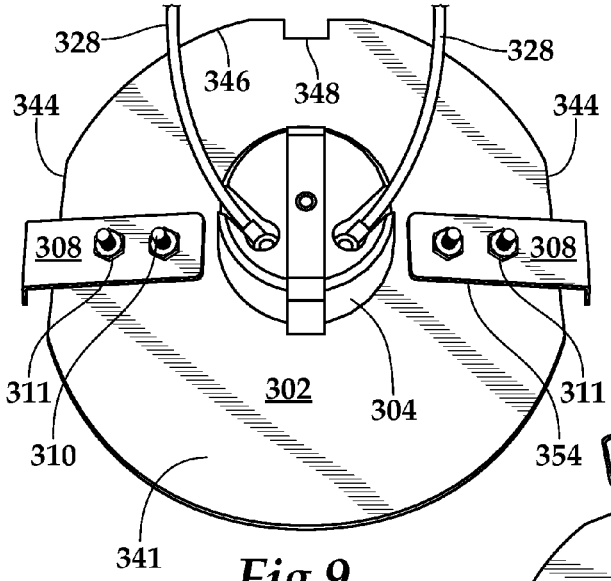
FIG. 9 is a perspective view of a support plate of FIG. 8.
Figure 10:
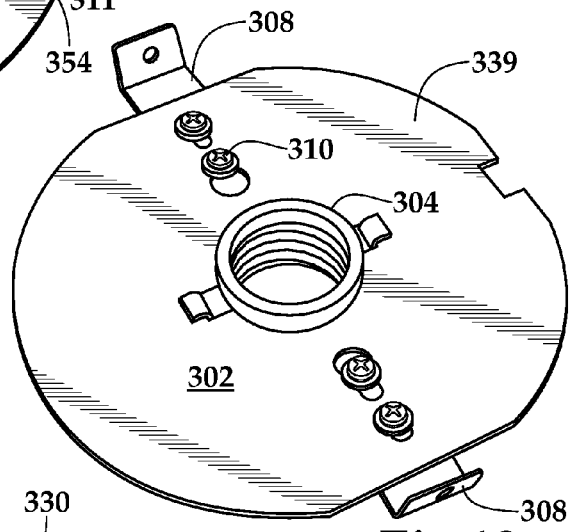
FIG. 10 is another perspective view of the support plate of FIG. 9.
Figure 11:
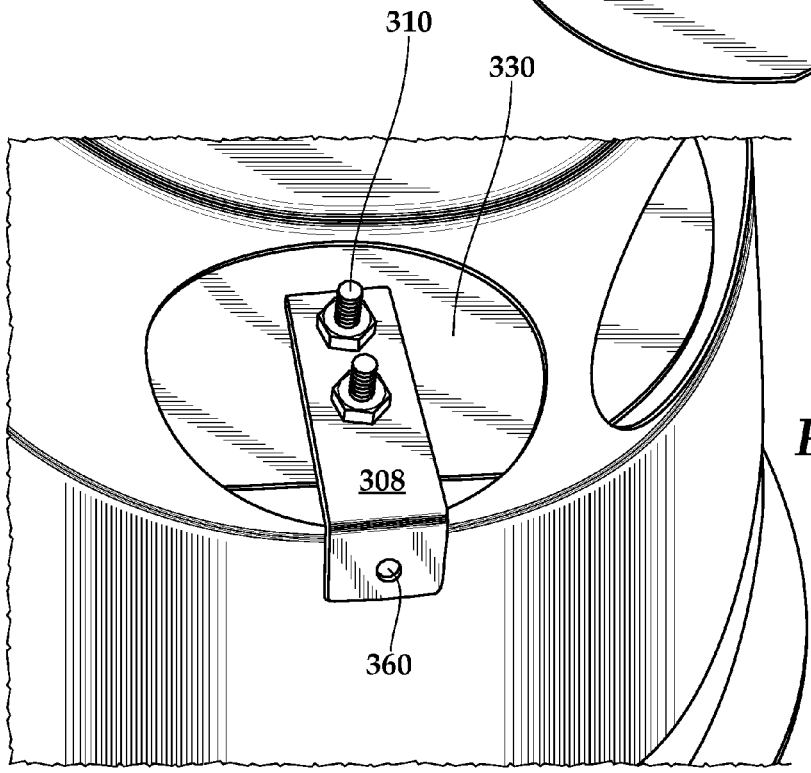
FIG. 11 is a perspective view of a mounting clip of FIG. 8.

Turning to FIGS. 9 and 10, can 306 may be configured to receive plate 302 and socket 304. Plate 302 and socket 304 may facilitate coupling lamp 14 within lighting can 306. Lamp 14 may be configured to couple to the socket, wherein the socket holds lamp 14 within lighting can 306.

Plate 302 may have an interior surface 339 and an exterior surface 341. Plate 302 is configured to be positioned a distance 340 from end 322. Distance 340 may be less than distance 316. Plate 302 may be generally round. In one embodiment, shown in FIGS. 9 and 10, plate 302 has a plurality of segments 342, wherein opposing segments 344 are generally straight and are separated by segments 346 that generally curved. In addition, in one embodiment, an indentation 348 may be defined within at least one segment 346. In one embodiment, each segment 344 facilitates coupling plate 303 to can 306. Further, plate 302 may include openings 345, wherein each opening 345 may receive at least one screw 310 therein.

Socket 304 may be coupled to plate 302 and may be configured to engage lamp 14. In one embodiment, socket 304 is generally round and may be an Edison socket.

3.3 Couplings 308

Continuing with FIGS. 9 and 10, system 300 may further include a plurality of couplings 308. Each coupling 308 may include an interior surface 353 and an exterior surface 355. Each coupling 308 further may include a first portion 354 and a second portion 356. First portion 354 may be generally normal to second portion 356 via a bend 358 and further second portion 356 may extend downward from first portion 354. In one embodiment, interior surface 353 of each coupling 308 is configured to couple to exterior surface 341 of plate 302, wherein at least one coupling 308 is proximate each segment 344. Additionally, in one embodiment, at least a portion of first portion 354 of coupling 308 extends outward from plate 302 and second portion 356 extends downward therefrom, such that each second portion 356 is configured to engage exterior surface 326 of can 306.

Moreover, as shown in FIG. 8, each portion 354 and 356 may include at least one opening 360 therein. Each opening 360 may be configured to receive a screw 310.

3.4 Screws 310

Continuing with FIG. 8, system 300 further includes a plurality of screws 310. Each screw 310 may include a head 350 and a body 352. Additionally, each screw 310 may be configured to receive a nut 311.

4. Assembly with System 300

To retrofit an existing compact fluorescent ceiling can fixture with system 300, the power may first be turned off to the existing fixture. The bulb from the existing fixture may be removed. The can of the existing fixture may be removed from the ceiling. A plurality of wires may be cut that run to the existing compact fluorescent lamp socket. The existing fixture junction box that supports the compact fluorescent ballast may be located. The power wires from the ballast may be disconnected. The plurality of wires from the output of the ballast may be removed. A plurality of the wires from the existing light socket may be connected to socket 304 that may be mounted to plate 302.

At least one coupling 308 may be coupled to plate 302. In one embodiment, two screws 310 are coupled to first portion 354 of coupling 308, wherein each screw 310 facilitates coupling portion 354 of coupling 308 to plate 302. Moreover, in one embodiment, first portion 354 is positioned a distance 351 from socket 304.

In one embodiment, coupling 308 is coupled to plate 302 by aligning at least one opening 360 with at least one opening 345, such that openings 345 and 360 are concentric. At least one screw 310 then may be inserted into openings 345 and 360, wherein head 350 may engage interior surface 339 of plate 302, and further wherein a nut 311 may engage body 352 of screw 310 and further may engage exterior surface 355. Nut 311 may be configured to engage exterior surface 355 of coupling 308.

Plate 302 with at least one coupling 308 may be coupled to can 306. In one embodiment, plate 302 is inserted proximate interior surface 324 of can 306 on an angle. Coupling 308 may then be inserted through opening 330, preferably from interior surface 324 to exterior surface 326.

Plate 302 may be moved until second portion 356 of portion 308 engages can 306. In one embodiment, interior surface 353 is configured to engage exterior surface 326 of can 306. Plate 302 may further be moved until at least one opening 334 is aligned with at least one opening 360, such that openings 334 and 360 are concentric. At least one screw 310 then may be inserted into openings 334 and 360. In one embodiment, head 350 may engage exterior surface of portion 356. A nut 311 may be configured to engage body 352 of screw 310 and may couple to interior surface 324 of can 306. Each screw 310 is then tightened to facilitate coupling plate 302 to can 306.

Once plate 302 is coupled to can 306, can 306 may be inserted into the ceiling, and lamp 14 may be coupled within socket 304. The power then may be turned on to test lamp 14.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A retrofit can lighting system configured to be mounted in an opening in a ceiling above a plane of the ceiling, wherein an existing fixture ceiling ring is proximate the opening and also is above the plane of the ceiling, said system comprising:

a lighting can;

a plurality of spring clips configured to couple between the lighting can and the ceiling ring, wherein each spring clip includes:

a can engaging portion configured to couple to the lighting can, a retainer clip engaging portion extending outwardly with respect to the can engaging portion, a fixture engaging portion configured to engage a portion of the ceiling ring, wherein the fixture engaging portion is angled upwardly with respect to the retainer clip engaging portion, and a hook portion configured to engage a portion of the ceiling ring, wherein the hook portion extends outwardly and downwardly with respect to the fixture engaging portion; and a plurality of retainer clips, wherein each retainer clip is configured to couple to retainer clip engaging portion, and further wherein each retainer clip is configured to secure coupling the lighting can and the ceiling ring.

2. A system in accordance with claim 1 wherein the can is a six inch can, and further wherein the opening has an eight inch diameter.

3. A system in accordance with claim 1 wherein the can engaging portion is generally straight and has a length of about 1.266".

4. A system in accordance with claim 1 wherein each spring clip further includes a spacing portion, wherein the spacing portion extends upwardly at an angle of about 30 degrees via a radius with respect to the hook portion.

5. A system in accordance with claim 4 further comprising a leading portion, wherein the leading portion extends upwardly and inwardly via a radius with respect to the spacing portion.

6. A system in accordance with claim 5 wherein the leading portion has a leading end, wherein the leading end is spaced inwardly of the existing fixture ceiling ring and inwardly of the fixture engaging portion.

7. A system in accordance with claim 1 further comprising a connecting portion, wherein the connecting portion extends between the retainer clip engaging portion and the fixture engaging portion, and further wherein the connecting portion is angled upwardly at an angle with respect to the retainer clip engaging portion via a radius.

8. A system in accordance with claim 1 further comprising a plurality of bolts, wherein at least one bolt is configured to couple at least one spring clip to the lighting can, and further wherein at least one bolt is configured to couple the spring clip and the retainer clip.

9. A system in accordance with claim 1 further comprising a trim ring assembly, wherein the trim ring assembly has a trim ring and a plurality of springs configured to couple the trim ring and the lighting can.

10. A spring clip comprising:

a can engaging portion configured to couple to a lighting can, a retainer clip engaging portion extending outwardly with respect to the can engaging portion, wherein the retainer clip engaging portion is substantially normal to the can engaging portion, a fixture engaging portion configured to engage a portion of a ceiling ring, wherein the fixture engaging portion is angled upwardly with respect to the retainer clip engaging portion, a hook portion configured to engage a portion of the ceiling ring, wherein the hook portion extends outwardly and downwardly with respect to the fixture engaging portion, a spacing portion extends upwardly at an angle via a radius with respect to hook portion, and a leading portion, wherein the leading portion extends upwardly and inwardly via a radius with respect to the spacing portion.

11. A clip in accordance with claim 10 wherein leading end is spaced inwardly of the fixture engaging portion.

12. A clip in accordance with claim 10 wherein fixture engaging portion and hook portion form an s-shaped portion.

13. A clip in accordance with claim 10 wherein a length between the leading end and the retainer clip engaging portion is about 2 inches.

14. A clip in accordance with claim 10 further comprising a width of about ½".

15. A clip in accordance with claim 10 wherein the spring clip is fabricated from a flexible material.

16. A clip in accordance with claim 10 further comprising at least one opening configured to receive a bolt therein.

17. A clip in accordance with claim 10 further comprising a plurality of washers configured to facilitate coupling a plurality of bolts thereto.

18. A method of assembling a retrofit can lighting system, said method comprising:

providing a lighting can;

coupling a plurality of spring clips to an exterior surface of the lighting can, wherein each spring clip includes:

a can engaging portion configured to couple to the exterior surface of the lighting can, a retainer clip engaging portion extending outwardly with respect to the can engaging portion, a fixture engaging portion configured to engage a portion of a ceiling ring, wherein the fixture engaging portion is angled upwardly with respect to the retainer clip engaging portion, and a hook portion configured to engage a portion of a ceiling ring, wherein the hook portion extends outwardly and downwardly with respect to the fixture engaging portion; and coupling at least one of retainer clip to each spring clip with at least one coupling mechanism, wherein each retainer clip is coupled to the retainer clip engaging portion of each spring clip.

19. A method according to claim 18, further comprising coupling a trim ring to the lighting can with at least one spring mechanism.

* * * * *